US005108022A

United States Patent [19]

Birkmair et al.

[11] Patent Number: 5,108,022

[45] Date of Patent: Apr. 28, 1992

[54] UNIVERSAL WEB TURNING SYSTEM, PARTICULARLY FOR PRINTED WEBS DERIVED FROM A ROTARY WEB-TYPE PRINTING MACHINE

[75] Inventors: Hubert Birkmair, Friedberg; Herbert Eberle, Dasing, both of Fed. Rep. of Germany

[73] Assignee: Man Roland Druckmaschinen AG, Offenbach am Main, Fed. Rep. of Germany

[21] Appl. No.: 683,508

[22] Filed: Apr. 8, 1991

Related U.S. Application Data

[63] Continuation of Ser. No. 347,417, May 4, 1989, abandoned.

[30] Foreign Application Priority Data

May 18, 1988 [DE] Fed. Rep. of Germany ..... 3816900

[51] Int. Cl.[5] ..... B65H 23/32; B65H 23/032; B65H 23/035

[52] U.S. Cl. ..... 226/197; 226/15; 226/189; 226/190; 226/194; 34/152

[58] Field of Search ..... 226/15, 18, 21, 189, 226/190, 194, 197; 34/152; 68/13 R

[56] References Cited

U.S. PATENT DOCUMENTS

| | | | |
|---|---|---|---|
| 978,234 | 12/1910 | Taylor | 34/152 X |
| 1,432,832 | 10/1922 | Brookett | 226/194 X |
| 2,005,517 | 6/1935 | Cluett | 226/197 X |
| 2,136,278 | 11/1938 | Dean | 270/5 |
| 2,284,318 | 5/1942 | Hamlin | 226/197 X |
| 2,733,061 | 6/1931 | Crafts | 226/21 |
| 2,760,773 | 8/1956 | Brodie | 226/197 |
| 3,434,639 | 3/1969 | Cowles | 226/21 |
| 3,763,520 | 10/1973 | Izawa et al. | 226/189 X |
| 4,816,844 | 3/1989 | Uchida et al. | 242/57.1 X |

FOREIGN PATENT DOCUMENTS

| | | |
|---|---|---|
| 2920684 | 11/1980 | Fed. Rep. of Germany . |
| 3127872 | 2/1983 | Fed. Rep. of Germany . |
| 3546346 | 8/1983 | Fed. Rep. of Germany . |

*Primary Examiner*—Daniel P. Stodola
*Assistant Examiner*—P. Bowen
*Attorney, Agent, or Firm*—Frishauf, Holtz, Goodman & Woodward

[57] ABSTRACT

To supply an arriving and delivered portion of a traveling web (1, 21, 31, 41, 81, 91, 101) to have the same side-orientation as the delivered portion, the web is passed about a first turning bar (2), then looped about a first deflection roller (3), and spanning the arriving portion of the web, about a second deflection roller (4) to be then turned again, selectively, by a second turning bar (5). Other web paths are possible, omitting the second deflection roller (4). Rather than using a single second deflection roller, smaller roller elements (FIG. 11: 16, 17) can be used, the second deflection roller, or the elements having effective diameters which are larger than the diameter of the first deflection roller. The turning bars and the deflection rollers are retained in an essentially rectangular frame, with the position of the turning bars adjustable along the sides of the frame and the position of the deflection rollers, likewise, preferably being longitudinally adjustable along the sides of the frame as well as height-adjustable perpendicular to the plane of the web traveling between the respective turning bars and deflection rollers.

19 Claims, 5 Drawing Sheets

UNIVERSAL WEB TURNING SYSTEM, PARTICULARLY FOR PRINTED WEBS DERIVED FROM A ROTARY WEB-TYPE PRINTING MACHINE

This application is a continuation of application Ser. No. 07/347,417, filed May 4, 1989, now abandoned.

FIELD OF THE INVENTION

Reference to related publication: A. Braun: "Atlas des Zeitungs- und Illustrationsdruckes" ("Atlas of Newspaper and Magazine Printing"), Frankfurt/Main (Fed. Rep. Germany), 1960, pp. 62, 63.

The present invention relates to a turning system for, selectively, turning, offsetting, or turning and offsetting, a web of material, especially a printed web received from a web-type rotary printing machine, such as a newspaper or magazine-type printing press, for example an offset printing press.

BACKGROUND

Turning apparatus usually use turning bars and, if necessary, also a deflection roller. The textbook, A. Braun: "Atlas des Zeitungs- und Illustrationsdruckes" ("Atlas of Newspaper and Magazine Printing"), Frankfurt/Main (Fed. Rep. Germany), 1960, pp. 62, 63, describes a turning arrangement which has two turning rods or bars which are located in crossed position. A run-on or arriving portion of a traveling web is deflected by 90° by a first turning rod. The web is then passed about a deflection roller, to be deflected by 180° and, then, is again deflected by a second turning bar by 90°. The result will be that the run-off or delivered web portion can be laterally offset with respect to the arriving portion. The respective sides, upper side and lower side of the web, however, are reversed in the arriving and delivered portion, in other words, the web has been turned over. For printed subject matter, that means that prime printing on the arriving portion will appear on the verso side of the web. By shifting one of the turning rods transversely to the arriving web portion, a lateral offset can be controlled, with certain limits. For certain types of paper handling and production of printed material, turn-over, or interchange of the prime and verso sides of the web, upon turning and, if desired offsetting, is undesirable.

The referenced literature, on page 62, further describes an arrangement in which two parallel turning rods are used, which deflect the arriving web twice by 90°, each time, so that the delivered web, or run-off web portion, will have the same side arrangement as the arriving web portion, that is, prime side will remain prime side after handling. At least one of the two turning rods can be shifted transversely to the arriving web, so that lateral offset of the traveling web is possible, within some limits.

For proper paper handling, the web should be wrapped about each one of the turning rods by precisely 180° in order to obtain precise deflection of 90°. Some offset, then, will necessarily arise when parallel turning rods are used. This offset cannot be avoided. The minimum offset of turning rods which are precisely above each other will be $$0.5 \cdot \sqrt{2d},$$

wherein d is the diameter of the turning rod.

THE INVENTION

It is an object to provide a turning system for webs which does not have the limits of prior art turning arrangements and in which the delivered or run-out web portion may, selectively, have the same side orientation as the arriving or run-on portion, an interchanged or reversed side orientation, that is, turned over and, further, which permits the run-off or delivery portion and run-on portion to have any desired or no lateral offset.

Briefly, an additional or further reflection roller is provided, rotatable about an axis parallel to the arriving portion of the web and located laterally at a side opposite the side of the first, and usually present deflection roller.

Providing a second, or further or additional deflection roller has the unusual and unexpected advantages that the overall turning system permits substantially more possibilities for turning than only a single deflection roller, so that an effectively universal web turning system is provided. The lateral offset of arriving and delivered web portions can be substantially increased over that heretofore possible, the direction of the arriving and delivery portion can be selected, and the orientation of the sides of the arriving and delivered web portions can be as desired, without constraint on the same or reversed positioning, only, of the respective sides.

DRAWINGS

DETAILED DESCRIPTION

Figure 1:
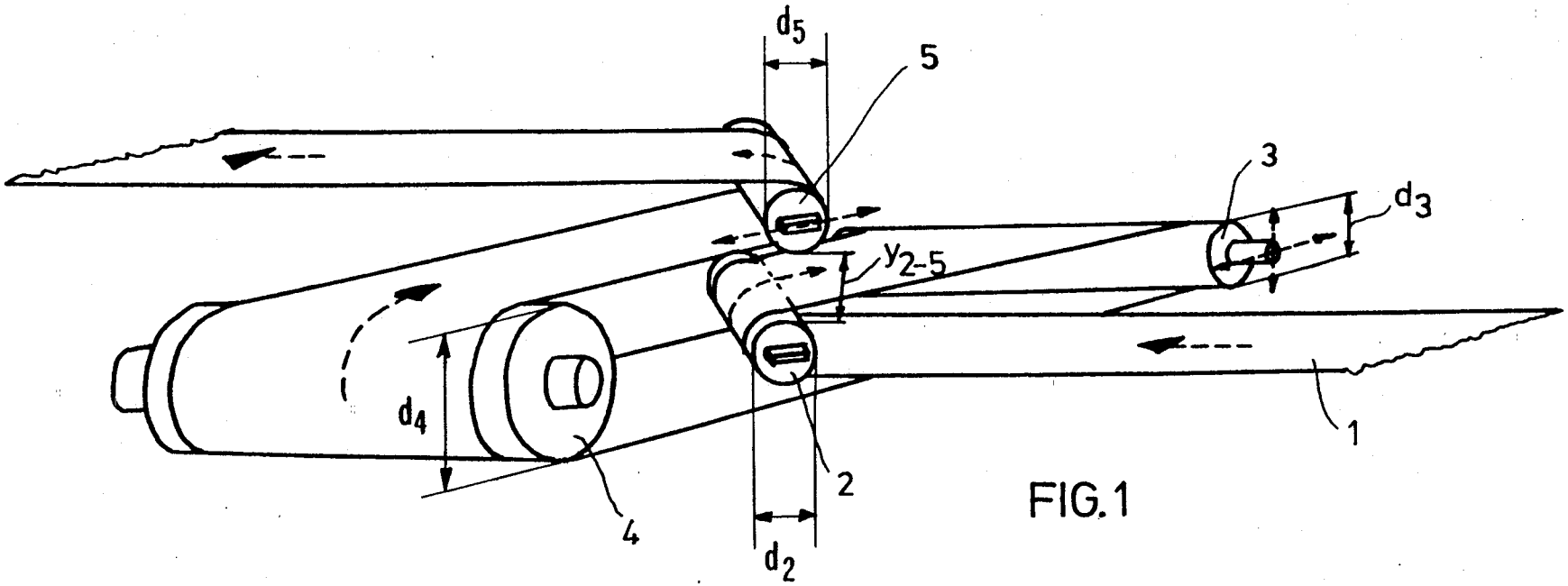
FIG. 1 is a perspective view of the turning arrangement in accordance with the invention, in which the upper, or prime side of the run-on portion of the web corresponds to the same side of the run-off portion of the web, and the lateral offset of the run-on and run-off portions is selectively adjustable, as desired.

Referring first to FIG. 1: The universal turning system uses, as known, two turning rods. In accordance with the present invention, not one but rather two deflection rollers are used, shown in relation to the turning rods in perspective representation. The web guidance corresponds to that shown in FIGS. 2 to 4.

A traveling web 1, for example derived from a web-type rotary printing machine, is guided about a first turning rod or bar 2, being wrapped from the bottom over the rod 2 to have an upper run-off portion from the turning rod. The direction of movement of the web is shown by the arrow on the web. The turning rod 2 is positioned by an angle of 45° with respect to the arriving or run-on portion of the web. The web, thus, is turned by the turning rod 2 by 90°, and deflected towards the right. The web is then guided over a deflection roller 3, where its direction of movement is changed without, however, changing the longitudinal orientation of the web.

In accordance with a feature of the present invention, a second deflection roller 4 is provided, in addition to the deflection roller 3, which may be termed a first deflection roller. The web is wrapped about the second deflection roller 4. The web passes from roller 3 beneath the run-on or arriving portion of the web 1 to a side remote from the turning rods 2 and 5. After passing over and about the second deflection roller 4, from the bottom towards the top, the web is then turned by a second turning rod or bar 5. The second deflection roller 4 changes the direction of movement of the web being delivered thereto, without, however, changing the longitudinal orientation of the web. The second turning rod 5, as shown in FIGS. 1 to 4, is parallel to the first turning rod 2. Each time, the web is guided about the turning rod 5 from the bottom and over towards the top, to be again deflected by 90°. The run-off or delivery portion of the web then will have the same upper side as the arriving portion of the web and, as shown in the further examples with reference to FIGS. 2 to 4, may have a lateral offset towards the left, towards the right, or no offset at all. Thus, by merely shifting the position of the turning rods, any desired relative placement of the run-on portions and run-off portions of the web can be obtained without change in the orientation of the sides of the web.

FIGS. 2 to 12 illustrate the same elements shown in FIG. 1, and the same reference numerals are used throughout. Since, however, the path of the web differs, the web has been given reference numerals incremented in the 10-digit by the respective number of the figures.

Comparing the path of the webs of FIGS. 2, 3, 4 and 8, 9, 10, it can be clearly seen that the two turning rods 2 and 5, as well as the deflection rollers 3 and 4 are, preferably, located in a common frame. This frame is formed of horizontal, superposed or vertically staggered cross elements 6, 7 and right-angle longitudinal carrier or support or rail elements 8. The turning rods 2, 5, respectively, as best seen in FIG. 5, are located in slide or bearing blocks 12, 15, respectively, which are slidable in the longitudinal elements 6, 7. The turning rods 2, 5, thus, can be shifted over essentially the entire of the length of the longitudinal elements 6, 7, while retaining their parallel orientation, at 45° with respect to the run-on portion of the web. Since they are vertically staggered, see the position of slide blocks 12 and 15 in FIG. 5, the bars can be placed in vertical alignment, or crossed.

Figure 2:
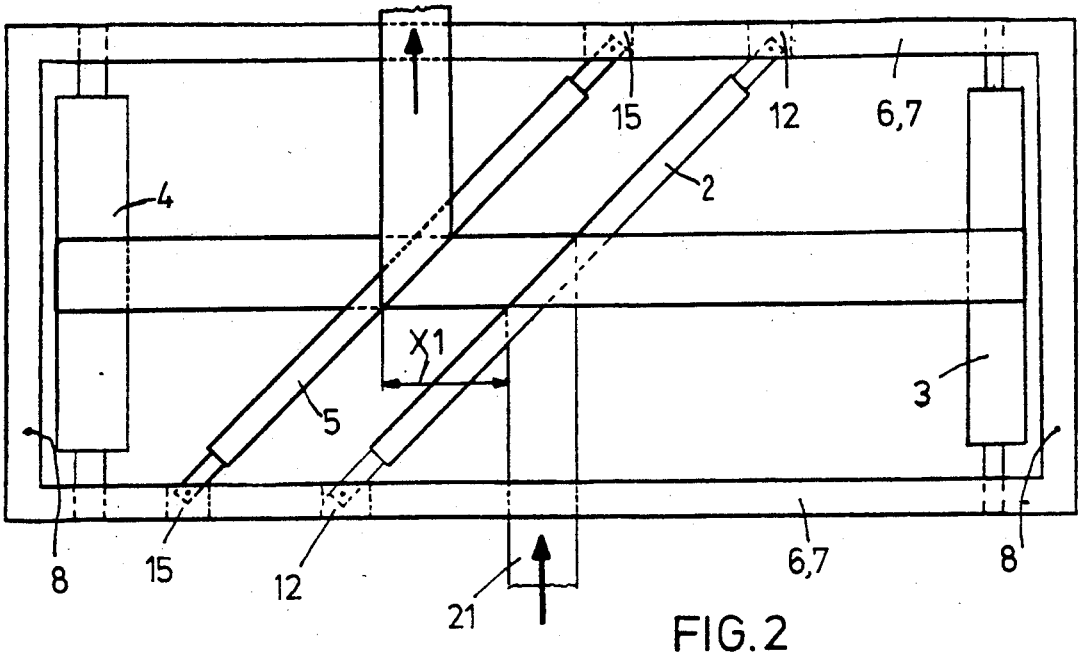
FIG. 2 is a top view of the system in which the path of the web is as shown in FIG. 1, and in which the arriving and delivered portions of the web are offset by a distance X1 towards the left.

FIG. 2 illustrates the web path in which the second turning rod 5 is offset towards the left with respect to the first turning rod 2 by a lateral shift or offset X1. As a consequence, the arriving web portion 21 is shifted with respect to the web guidance path of FIG. 1 to the left by a lateral shift or offset X1. This shift or offset corresponds to the horizontal distance between the two turning rods 2, 5, less the diameter of one turning rod. The deflection rollers 3, 4 are located at extreme ends of the frame 6, 7, 8.

Figure 3:
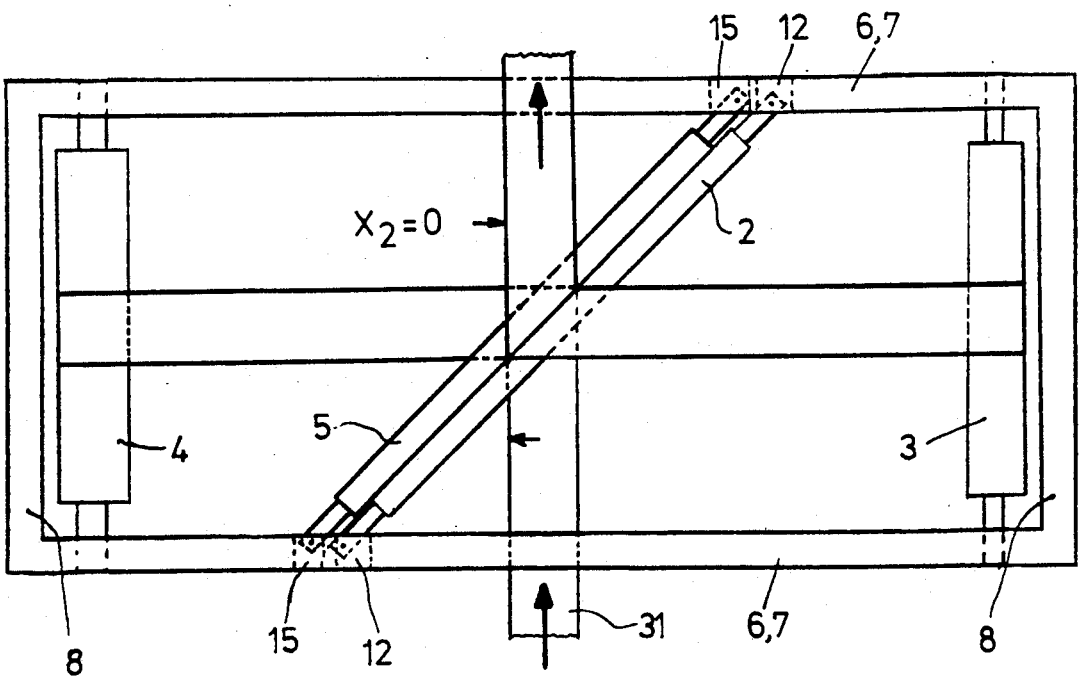
FIG. 3 is a top view of the system of FIG. 1 in which the run-off portion and the run-on portion are in precise alignment, so that the offset $X_2$ is zero or null.

FIG. 3 illustrates the universal applicability of the system of the present invention in that, if it is desired for another web path, to have the run-on portion of the web 31 and the run-off portion in precise alignment, the turning rods can be located such that the second turning rod 5, in vertical projection, is precisely next to the first turning rod 2, so that the lateral offset $X_2$ of the arriving portion of the web with respect to the delivery portion of the web will be zero or null. This maintains the web path length through the system although neither the direction nor the side orientation nor the offset of the web is changed.

Figure 4:
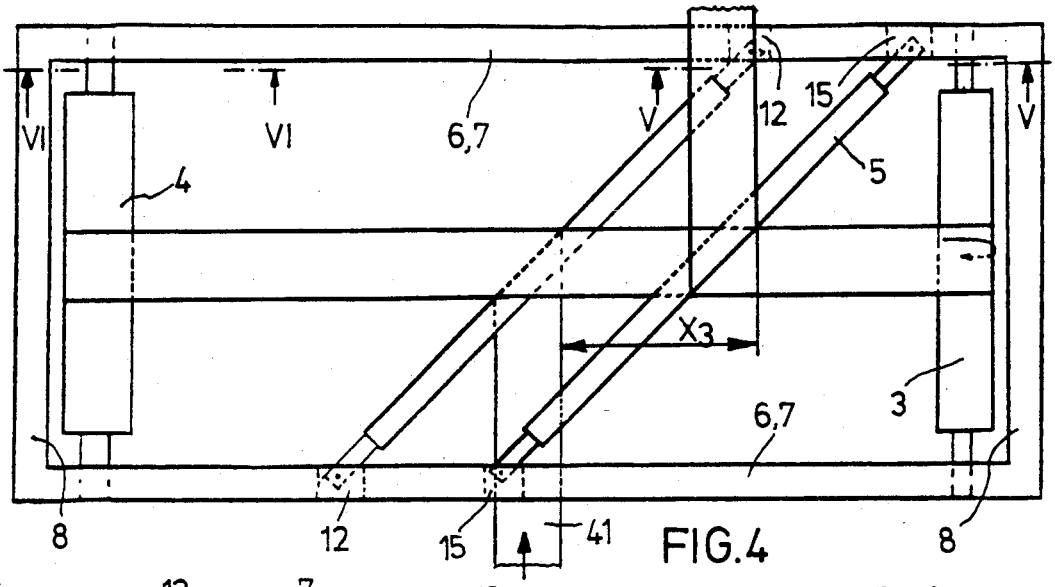
FIG. 4 is a top view of the system of FIG. 1, in which the run-off portion is offset with respect to the run-on portion by a distance X3 towards the right.
Figure 5:
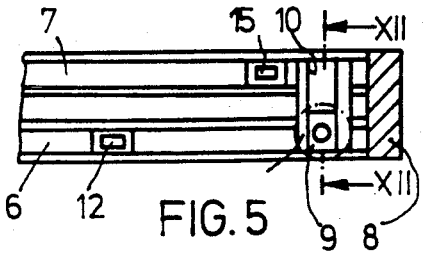
FIG. 5 is a section along line V—V of FIG. 4, and illustrating guidance of the turning rods and movable positioning of the first deflection roller within a frame.

FIG. 4 illustrates the position in which the second turning rod 5 is shifted towards the right with respect to the first turning rod 2 by a predetermined spacing. A web 41, thus, is shifted by a distance X3 towards the right, in which the distance X3 corresponds to the horizontal spacing of the two turning rods 2 and 5 less the diameter of one turning rod. As can be seen by comparing FIGS. 2, 3 and 4, the turning rods 2, 5 are shiftable independently.

Figure 6:
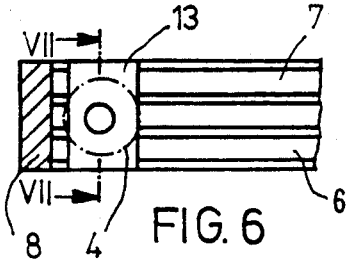
FIG. 6 is a section line along line VI—VI of FIG. 4, illustrating the bearing arrangement for the second or further or additional deflection roller.

FIG. 4 also shows the section lines V—V and VI—VI, respectively, so that the representations of FIGS. 5 and 6 can be easily identified.

The upper longitudinal rail 6, 7 is shown in fragmentary representation in FIG. 5. The upper longitudinal rail is shown at 7 and the lower one at 6. Both rails 6, 7 are attached at their terminal ends to cross elements 8, and together with the cross elements form a closed frame. The upper and lower longitudinal elements 6, 7, as illustrated in FIG. 4, can be identical. The longitudinal elements 6, 7 are formed of shaped rails which, in cross section, are essentially U-shaped, as seen also in FIG. 7. The rails 6, 7 thus define, each, a groove, facing the inside of the frame. Slide elements 15 are slidable in the upper rail 7. Their sliding position can be locked. The slide elements 15 receive and hold the ends of the second turning rod 5. The lower longitudinal element 6 retains slide elements 12 which hold the ends of the first turning rod 2; the slide elements or slide blocks 12, 15, each, can be locked in place by suitable clamps, not shown, and of any desired construction.

Figure 12:
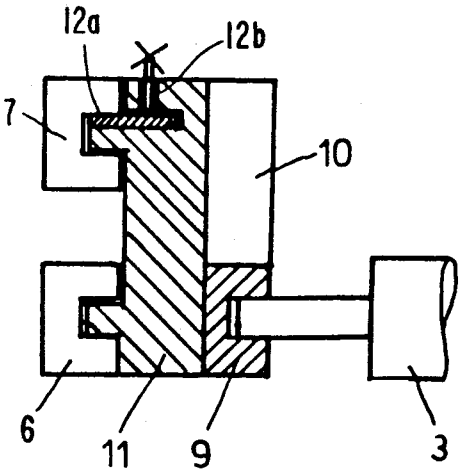
FIG. 12 is a fragmentary sectional view along line XII—XII of FIG. 5.

In accordance with a preferred feature of the invention, the deflection rollers 3 and 4 are located in bearing blocks 9 which can be shifted longitudinally horizontally as well as vertically. As seen in FIGS. 5 and 12, the bearing block 9 can be moved in a vertical guide groove 10 (see FIG. 12), and can be clamped in position where desired. The vertical guide groove 10 is formed in the slide element 11 which is fitted in the grooves 6 and 7 of the lower and upper longitudinal rails, respectively.

The bearing block 9 can be shifted not only up-and-down but also longitudinally along the rails 6, 7. Horizontal shifting of the first deflection roller 3 is of advantage since, upon parallel shifting of the turning rods 2, 5, the length of the web path within the entire turning system changes. This change can be compensated by horizontal shifting or sliding of one or both of the deflection rollers 3, 4. Thus, any specific reference or register position of a printed web can be retained with respect to run-on or arriving and run-off or delivery position of the web in relation to a fixed reference. Vertical shifting of the first deflection roller 3 is desirable to permit the variations in web path illustrated in FIGS. 8 and 9, and will be explained in greater detail in connection with those drawing figures. A suitable clamping arrangement for block 11 on the rails 6, 7 is illustrated in FIG. 12 by a clamping plate 12*a* which can be clamped against the inside of the U-shaped groove by a clamping screw 12*b*.

Figure 7:
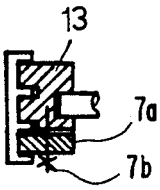
FIG. 7 is a detail view of FIG. 6, and taken along section line VII—VII of FIG. 6.

FIG. 6, which is a sectional view along line VI—VI of FIG. 4, illustrates another portion of the rails 6, 7, shown in FIG. 4. The bearing arrangement for the second deflection roller 4 is shown in detail. In accordance with a preferred feature of the invention, and as best seen in FIGS. 6 and 7, the bearing for deflection roller 13 likewise is horizontally shiftable. The ends of the roller 4 are located in bearing blocks 13 (see FIG. 7) which are guided in at least one of the grooves, and here the groove in the longitudinal rail 7. The groove of the lower longitudinal element 6 carries a clamping plate 7*a*, which can be clamped against the block 13 by a screw 7*b*. Upon tightening of the screw 7*b*, the clamping block 7*a* as well as the bearing block 13 are securely clamped in position in the respective grooves of the rails 6, 7.

Figure 8:
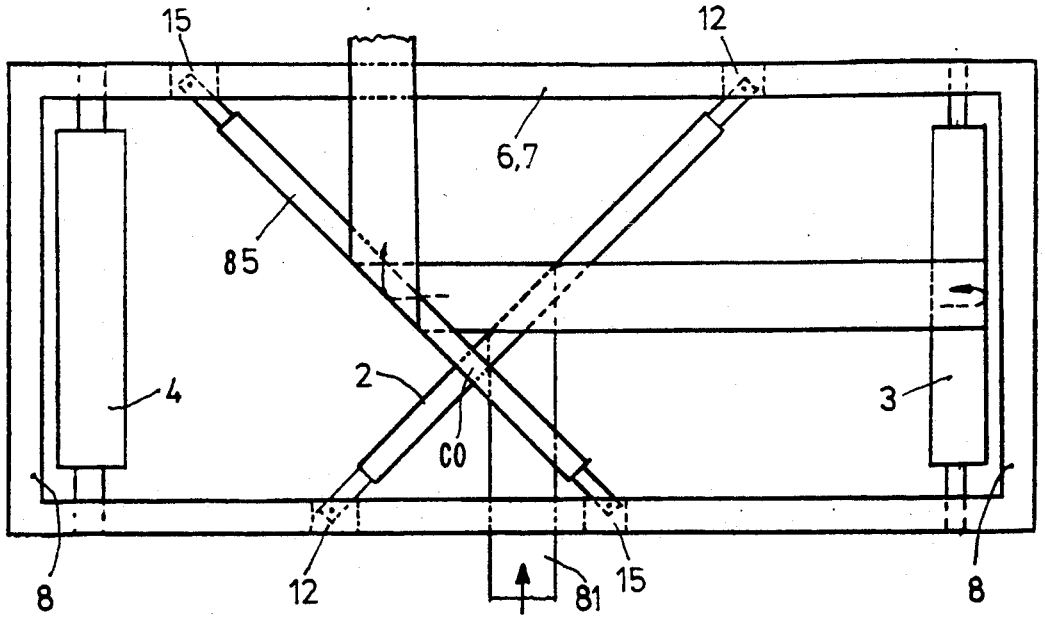
FIG. 8 illustrates an arrangement of the system in which the turning rods are located in crossed arrangement, and in which the run-off web is turned over and laterally shifted to any desired extent with respect to the run-on web.

While the present invention, for maximum versatility, utilizes the two deflection rollers 3, 4, it is not necessary to always pass the web over both the rollers 3, 4. As seen in FIG. 8, the web 81 is passed over turning rod 82 which is located at an angle of 90° with respect to turning rod 85. The turning rods 82, 85, therefore, are in crossed position. The first deflection roller 3 is an upper position, that is, different from the position of the deflection roller shown in FIG. 5. Preferably, the longitudinal shift corresponds to the diameter of the deflection roller. The arriving web 81 is guided, from below, about the turning rod 82, and thereby turned to the right. The web then passes from below around and to the upper side of the deflection roller 3 and guides the web 81 to the second turning rod 5, where the web is again guided from below and around the turning rod, deflecting the web by 90° towards the right and, thereby, imparting to the delivery portion of the web a direction parallel to, but laterally offset from the arriving direction of the web 81. The upper side of the delivered web portion corresponds to the lower side of the arriving web, so that the prime side on the web now becomes the verso side.

The turning rod 5 can be shifted parallel to the position shown so that any, or no lateral offset of the delivered portion of the web with respect to the arriving portion thereof can be obtained. The cross-over point CO will shift along the bars as bar 5 is shifted. The second deflection roller 4 is not used in this web path.

Figure 9:
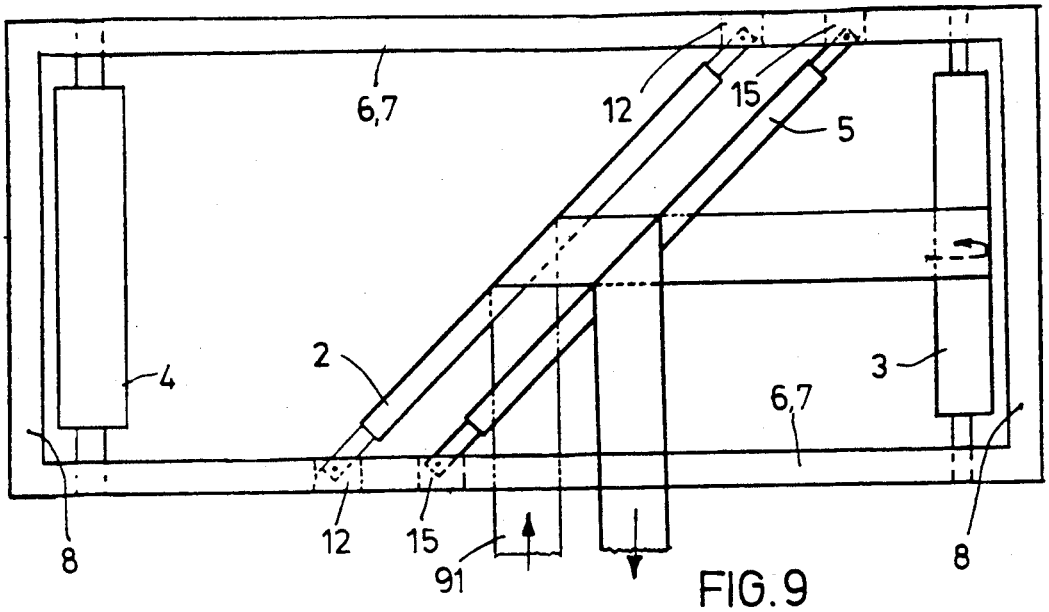
FIG. 9 illustrates the system in which the sides of the run-on and run-off web portions are interchanged, and can be laterally offset by any desired amount and guided back parallel to the run-on web.

FIG. 9 illustrates an arrangement in which the turning rods 2 and 5 are parallel to each other, and in which the webs again are reversed, or turned over side-over-side, and the second deflection roller 4 is not utilized.

The first deflection roller 3 is shifted to a central position, that is, moved upwardly by a distance corresponding preferably to its diameter. The arriving web 91 is passed from below about the turning rod 3, to be deflected by 90° towards the right. The web then is looped from below about the first deflection roller 3, for deflection by an angle of 180°. The second turning rod 5 is positioned parallel to the first turning rod 2, and the web 91 passes thereabout from below, to be deflected at the upper run or delivery portion of the web by 90° towards the left. The web, thus, is reversed in direction in that the arriving portion and the delivery portion are parallel to each other, with prime side reversed. Any, or no desired offset between the arriving portion and delivery portion can be obtained by shifting the turning bars or rods 2, 5 in the respective grooves of the rails 6, 7.

Figure 10:
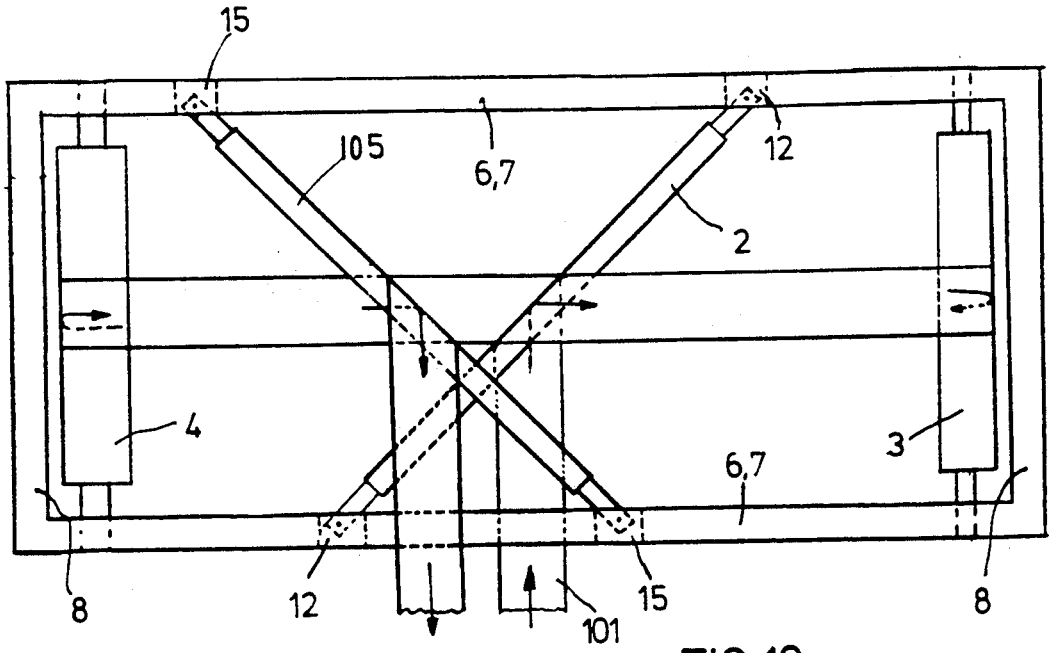
FIG. 10 illustrates an arrangement in which the run-off web portion is returned at the same side as the run-on portion, with the same orientation of the sides, and with any desired offset.

FIG. 10 illustrates another possible web path in which the web is not reversed or turned over, side-for-side, so that the arriving portion of the web 101 and the delivery portion of the web will have the same prime side.

The first deflection roller 3 is set in its height in the same position as in FIGS. 1–4, that is, the level is such that the upper edge of the deflection roller 3 corresponds to the upper edge of the first turning rod 2; in other words, the two upper edges are in a single horizontal plane, or in the plane parallel to the frame 6, 7. The arriving web 101 is first turned, as in FIGS. 1–4, about the turning rod 2, then deflected 180° by the first deflection roller 3, and then guided about the second deflection roller 4, from below. Differing, however, from the embodiments of FIGS. 1–4, the second turning rod 105 is crossed with respect to rod 2. The run-on and run-off wheels are next to each other. By parallel shifting of one or the other of the turning rods 2 or 105, any desired lateral offset can be obtained.

Reference has been made in connection with the foregoing examples to a desired lateral offset. The lateral offset, of course, is determined by the dimensions of the frames 6, 7, 8, as well as the sizes of the bearing blocks for the deflection rollers and the holding elements and slide blocks for the turning rods. Of course, the width of the web 1, and the other webs, also plays a part. As a general principle, however, the system should be so designed that it can accomodate the maximum width of web to be expected. The maximum shift also is known, so that the frame can be suitably dimensioned, considering also the space taken up by the deflection elements with its bearings and bearing blocks, and the slide elements for the turning rods.

In order to permit universal use of the system by being able to accomodate various paths of the web, it is necessary to consider the following conditions upon determining the diameters of the turning rods and the deflection rollers:

the diameters $d_2$ and $d_5$ of the turning rods 2, 5 preferably are identical;

diameter $d_3$ of deflection roller 3 should preferably correspond to the vertical spacing $Y_{2\text{-}5}$ between the upper edge of rod 2 and the lower edge of rod 5, and should be greater than the diameter $d_2$ of the first turning rod 2;

the diamter $d_4$ of the second deflection roller 4 should correspond to the vertical distance from the lower edge of the first deflection roller 3, when in lower position (FIG. 5), to the lower edge of the second turning rod 5; this is the spacing between the arriving portion of the web 1 after having been deflected by turning bar 2 and looped over roller 3, and the delivery portion of the web before passing around the second turning bar 5.

Mathematically, and considering the diameters of the turning rods 2 or 5 at a base value of unity:

$$d_2=d_5=1;\ d_3=Y_{2\text{-}5}=1.5;\ d_4=3,$$

that is, the turning rods or bars are smaller than either of the deflection rollers.

Other relationships of diameters may be used; the foregoing example is illustrative of preferred dimensions.

Figure 11:
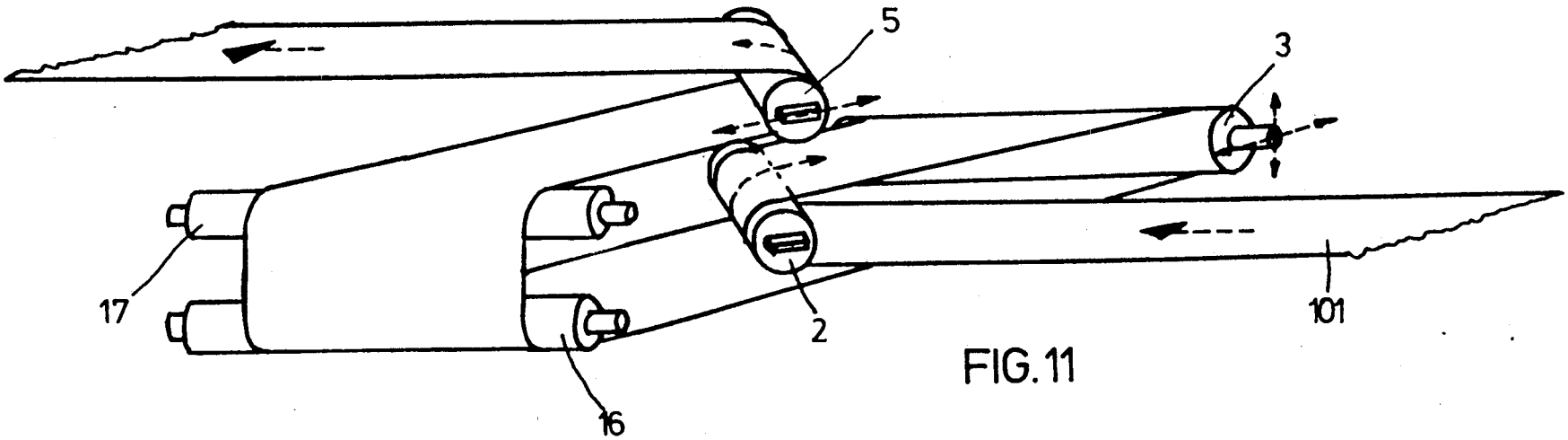
FIG. 11 is a perspective view illustrating another embodiment of the system of FIG. 1, and in which the second or further deflection roller is replaced by a set of vertically spaced roller elements.

It is not necessary that the second deflection roller 4 is a single roller element; as illustrated in FIG. 11, the second deflection roller 4 can be replaced by a pair of parallel smaller deflection roller structures 16, 17. The respective diameters of the roller structures 16, 17, and their spacing, should be so selected that the sum of the diameters, plus the spacing of the lower edge of the upper roller elements 17 from the upper edge of the lower roller elements 16 corresponds to the diameter of the second deflection roller 4 (FIG. 1). It is only necessary to provide a suitable modification for the bearing block 13 to retain the two roller elements 16, 17. All the various web paths illustrated in the prior figures can be used with this modification.

It is clear that it is not necessary to utilize the entire paths illustrated in the drawings. For example, the webs 21, 31, 41 (FIGS. 2–4) can be so arranged that they are wrapped about the first deflection roller 3 by an angle of only 90° and thus are deflected directly downwardly at the right side of the system, without passing the web about the second deflection roller 4 and the second turning rod 5. Alternatively, the webs 1, 21, 31, 41, in accordance with FIGS. 1–4, can be guided only about the second deflection roller 4, by an angle of 90°, and then delivered upwardly, without utilizing the second turning rod 5. As another alternative, the webs 81, 91 (FIGS. 8, 9) are wrapped about the first deflection roller 3 by only 90° and then guided upwardly away at the right side of the system. The first deflection roller 3 then preferably is in an upper position. The deflection roller elements 16, 17, in accordance with FIG. 11, are preferably so arranged that at least one of them can be shifted in vertical direction, and locked in position. If this arrangement is used, the web can be deflected downwardly also at the left side of system.

The turning rods can include any well known turning rod systems, for example subjected to air blasts or air wash and be connected at one end to a source of compressed air, to provide air cushions. Likewise, one or both of the deflection rollers may be cooled, and/or driven from a suitable drive source.

Various changes and modifications may be made, and any features described herein may be used with any others, within the scope of the inventive concept.

We claim:

1. Universal web turning system for guiding a traveling web (1, 21, 31, 41, 81, 91, 101) of material supplied from a web-type rotary printing machine, said traveling web defining a direction of web travel, an arriving portion, and a delivery portion, said system being capable of selectively guiding the web in any one selected mode as follows:

(a) without turning over, without offset, and with maintenance of direction of travel, whereby the arriving and delivery portions will be in alignment;

(b) without turning over with lateral offset, and with maintenance of direction of travel, whereby the arriving and delivery portions will be laterally offset with respect to each other;

(c) turning over without offset, and with maintenance of direction of travel, whereby the arriving and delivery portions will be in alignment, but reversed side-for-side;

(d) turning over, with lateral offset, and with maintenance of direction of travel, whereby the arriving and delivery portions will be laterally offset with respect to each other and reversed side-for-side;

(e) without turning over and with reversal of direction of travel, whereby the delivery portion will travel parallel to, but in opposite direction of the arriving portion; and (f) turning over and with reversal of direction of travel, whereby the delivery portion will be reversed side-for-side with respect to the arriving portion, and will travel parallel to, but in opposite direction of, the arriving portion, said system comprising a frame structure (6, 7, 8) including longitudinal frame elements extending at right angles to the direction of travel of the arriving portion of the web;

a first turning bar (2) deflecting said web at an angle with respect to the direction of travel of the arriving portion;

a second turning bar (5, 85, 105) deflecting said web at an angle with respect to the direction of travel of the web at the delivery portion;

a deflection roller (3);

a deflection roller means (4);

means (12, 15) for shiftably mounting said turning bars on said frame structure for selectively shifting the position of at least one turning bar, to-and-fro, in a shift path at right angles with respect to the direction of travel of the arriving portion of the web with respect to, and independently of, the other turning bar, said first and second turning bars (2; 5, 85, 105) being positioned on said frame radially staggered with respect to each other to permit passage of one bar over the other;

said deflection roller (3) being rotatable about an axis parallel to the arriving portion of the web and being located laterally at a first side of said turning bars (2; 5, 85, 105); and said deflection roller means (4) being rotatable about an axis parallel to the arriving portion of the web and being located laterally at a second side of said turning bars (2; 5, 85, 105) opposite said first side, said first and second turning bars being selectively positionable in said frame in a first position for guide mode (a) in which said bars are parallel to each other and extend at an angle with respect to the arriving portion of the web, and with one turning bar (5) in vertical projection being next to the other turning bar (2) and, upon said arriving portion of the web being looped about said first turning bar (2) and said deflection roller (3) for reversing the direction of travel of the web thereover and said web then being passed around said deflection roller means (4) from below for again reversing the direction of travel of the web and then over said second turning bar (5);

said first and second turning bars being selectively positionable in said frame in a second position for guide mode (b) in which said bars are parallel to each other and extend at an angle with respect to the arriving portion of the web and with one turning bar (5) being laterally offset or shifted (X1, X3) with respect to the other turning bar and upon said arriving portion of the web being looped about said first turning bar (2) and said deflection roller (3) for reversing the direction of travel of the web thereover and said web then being passed around said deflection roller means (4) for again reversing the direction of travel of the web and then over said second turning bar (5);

said first and second turning bars being selectively positionable in said frame in a third position for guide mode (c) in which said bars are crossed with respect to each other, defining a cross-over point (CO), and extend at an angle with respect to the arriving portion of the web, said cross-over point being located in the middle of said turning bars, and, upon said arriving portion of the web being looped about said first turning bar (2) and said deflection roller (3) for reversing the direction of travel of the web thereover and said web then being passed directly around said second turning bar;

said first and second turning bars being selectively positionable in said frame in a fourth position for guide mode (d) in which said bars are crossed over with respect to each other, defining a cross-over point (CO), extend at an angle with respect to the arriving portion of the web and with said cross-over point being located spaced from the middle of said first turning bar, and, upon said arriving portion of the web being looped about said first turning bar (2) and said deflection roller (3) for reversing the direction of travel of the web thereover and said web then being passed directly around said second turning bar;

said first and second turning bars being selectively positionable in said frame in a fifth position for guide mode (e), in which said bars are crossed over with respect to each other defining a cross-over point (CO), and extend at an angle with respect to the arriving portion of the web and, upon said arriving portion of the web being looped about said first turning bar (2) and said deflection roller (3) for reversing the direction of travel of the web thereover and said web then being passed around said deflection roller means (4) for again reversing the direction of travel of the web and then over said second turning bar; and said first and second turning bars being selectively positionable in said frame in a sixth position for guide mode (f) in which said bars are parallel to each other and extend at an angle with respect to the arriving portion of the web and, upon said arriving portion of the web being looped about said first turning bar (2) and said deflection roller (3) for reversing the direction of travel of the web thereover and said web then being passed directly around said second turning bar (5).

2. The system of claim 1, wherein, for modes (a), (b) and (f), said turning bars (2, 5) are positioned parallel to each other.

3. The system of claim 1, wherein, for modes (c), (d) and (e), one of the turning bars (85, 105) is located at a right angle with respect to the other (2) of said turning bars.

4. The system of claim 1, wherein the diameter ($d_3$) of the deflection roller (3) is greater than the diameter ($d_2$) of that one (2) of the turning bars about which the arriving portion of the web is first looped.

5. The system of claim 1, wherein the effective diameter ($d_4$) of the deflection roller means (4) is larger than the diameter ($d_3$) of the deflection roller (3).

6. The system of claim 1, wherein said deflection roller means (4) comprises two vertically staggered deflection roller elements (16, 17).

7. The system of claim 6, wherein the sum of the diameters of the deflection roller elements (16, 17) and the shortest distance between the surfaces of the deflection roller elements (16, 17) from each other is larger than the diameter ($d_3$) of the deflection roller (3).

8. The system of claim 1, further including slidable holding blocks located on said longitudinal frame elements of the frame structure for retaining end portions of said turning rods while permitting shifting of said turning rods along said longitudinal frame elements.

9. The system of claim 8, further including cross elements (8) coupled to said longitudinal frame elements to define an essentially rectangular frame therewith, and forming said frame structure;

and bearing blocks (9, 11; 15) for retaining the deflection roller (3) and said deflection roller means (4) in said frame structure.

10. The system of claim 9, wherein said bearing blocks (9, 11; 13) are slidable along said longitudinal frame elements.

11. The system of claim 9, wherein said bearing blocks (9, 11, 13) are slidable in a direction perpendicular to said longitudinal frame elements to provide for height adjustment of the respective deflection roller and deflection roller means with respect to said frame structure.

12. The system of claim 1, wherein at least one of the deflection roller (3) and the deflection roller means (4; 16, 17) is adjustable in a plane perpendicular to the plane of the arriving portion of said web.

13. The system of claim 1, wherein, for modes (a) and (b), said deflection roller (3) and said deflection roller means (4; 16, 17) are positioned at levels, with respect to a plane defined by the arriving portion of said web, relative to each other to provide for passage of the web from the deflection roller (3) beneath the web looped about the first turning bar (2) and then from below about the deflection roller means (4; 16, 17).

14. The system of claim 1, wherein said frame structure (6, 7, 8) is essentially rectangular and has shorter and longer sides; and further including means (9, 11, 13) for journalling said deflection roller (3) and said deflection roller means (4; 16, 17) adjacent the shorter sides of said essentially rectangular frame while permitting sliding movement of at least one of: said deflection roller (3) and said deflection roller means (4; 16, 17) longitudinally along the longer sides of said essentially rectangular frame;

and wherein said turning rods (2, 5) are slidably located on said essentially rectangular frame at an angle of 45° with respect to the longer sides of the frame, to permit said web (1, 21, 31, 41, 101) to be looped about the first turning bar (2), then about said deflection roller (3), then crossing the arriving portion of said web and said first turning bar, to be then looped about the deflection roller means (4; 16, 17), and then passed about the second turning bar (5, 105), whereby a first or prime side of the delivery portion of the web from sid system will be oriented at the same side as the first or prime side of the arriving portion of the web.

15. The system of claim 14, wherein the effective diameter of the deflection roller means (4; 16, 17) is larger than the diameter of said deflection roller (3) and of sufficient diameter to permit the web run between said deflection roller (3) and said deflection roller means (4) and cross at least one of: the arriving portion of the web; the delivery portion of the web.

16. The system of claim 11, wherein each of said turning bars (2; 5, 85, 105) is independently shiftable with respect to the arriving portion of the web.

17. The system of claim 1, wherein the effective diameter ($d_4$) of the deflection roller means (4) corresponds to the spacing between the arriving portion of the web, after having been looped about the deflection roller (3) and the delivery portion of the web, before passing around the second turning bar (5, 85, 105).

18. The system of claim 17, wherein the diameters ($d_2$; $d_5$) of said turning bars (2; 5, 85, 105) are, respectively, smaller than the diameter of either of said deflection roller (3) and said deflection roller means (4).

19. The system of claim 11, wherein the diameters ($d_2$; $d_5$) of said turning bars (2; 5, 85, 105) are, respectively, smaller than the diameter of either of said deflection roller (3) and said deflection roller means (4).

* * * * *